US010222720B2

(12) United States Patent
Tomiie

(10) Patent No.: US 10,222,720 B2
(45) Date of Patent: Mar. 5, 2019

(54) IMAGE FORMING APPARATUS CONTROLLING APPLIED CHARGING VOLTAGE BASED ON POTENTIAL OF ELECTRODE FILM

(71) Applicant: KYOCERA Document Solutions Inc., Osaka-shi, Osaka (JP)

(72) Inventor: Norio Tomiie, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/771,983

(22) PCT Filed: Sep. 6, 2017

(86) PCT No.: PCT/JP2017/032020

§ 371 (c)(1),
(2) Date: Apr. 27, 2018

(87) PCT Pub. No.: WO2018/070142

PCT Pub. Date: Apr. 19, 2018

(65) Prior Publication Data

US 2018/0348663 A1 Dec. 6, 2018

(30) Foreign Application Priority Data

Oct. 11, 2016 (JP) ..... 2016-199674

(51) Int. Cl.
*G03G 15/02* (2006.01)
*G03G 15/08* (2006.01)
(Continued)

(52) U.S. Cl.
CPC ..... *G03G 15/0806* (2013.01); *G03G 15/0266* (2013.01); *G03G 15/0898* (2013.01);
(Continued)

(58) Field of Classification Search
CPC ..... G03G 15/0806; G03G 15/0898; G03G 15/0266; G03G 15/5037; G03G 15/5041; G03G 21/00; G03G 2215/0602
See application file for complete search history.

(56) References Cited

U.S. PATENT DOCUMENTS 6,144,820 A * 11/2000 Ishii ..... G03G 15/0898 399/103
6,278,849 B1 * 8/2001 Kawasaki ..... G03G 15/0812 399/284
2010/0054773 A1 * 3/2010 Ogura ..... G03G 15/0266 399/48

FOREIGN PATENT DOCUMENTS

JP 2007199094 A 8/2007

* cited by examiner

*Primary Examiner* — Sophia S Chen
(74) *Attorney, Agent, or Firm* — Alleman Hall Creasman & Tuttle LLP

(57) ABSTRACT

In an image forming apparatus, a seal member is a non-conductive, flexible member supported by a developing device. The seal member is formed to project from an edge part of the developing device that faces an image carrying member, along a longitudinal direction of the image carrying member. The seal member fills a part of a gap between the developing device and an outer circumferential surface of the image carrying member. An electrode film is adhered to a surface of the seal member. The electrode film is a conductive film. A potential detecting device detects a potential of the electrode film. A charging controller controls a charging voltage based on a result of comparison between a predetermined reference potential and the potential detected by the potential detecting device.

4 Claims, 4 Drawing Sheets

(51) Int. Cl.
*G03G 15/00* (2006.01)
*G03G 21/00* (2006.01)

(52) U.S. Cl.
CPC ..... *G03G 15/5037* (2013.01); *G03G 15/5041* (2013.01); *G03G 21/00* (2013.01); *G03G 2215/0602* (2013.01)

IMAGE FORMING APPARATUS CONTROLLING APPLIED CHARGING VOLTAGE BASED ON POTENTIAL OF ELECTRODE FILM

TECHNICAL FIELD

The present invention relates to an image forming apparatus that can control the surface potential of an image carrying member.

BACKGROUND ART

In an electrophotographic image forming apparatus, a charging device charges an outer circumferential surface of an image carrying member via a charging member such as a charging roller. In addition, a laser scanning unit writes an electrostatic latent image on the outer circumferential surface of the image carrying member. Furthermore, a developing device develops the electrostatic latent image to a toner image.

Charging the outer circumferential surface of the image carrying member to a predetermined target potential is important to obtain a toner image of an excellent image quality. Accordingly, a charging voltage applied to the charging member is controlled so that the outer circumferential surface of the image carrying member is charged to the target potential. In that case, a surface potential sensor that detects the surface potential of the image carrying member in a contactless manner is used.

In addition, it is known that a controller controls the charging voltage based on detected values of the temperature and humidity of the installation environment, and a current flowing between the charging member and the image carrying member (see, for example, PTL 1). The detected values of the temperature, humidity, and current are indirect parameters that affect the surface potential of the image carrying member.

CITATION LIST

Patent Literature

[PTL 1] Japanese Patent Application Publication No. 2007-199094

SUMMARY OF THE INVENTION

Problems to be Solved by the Invention

Meanwhile, a typical surface potential sensor has a probe which is approximately 5 to 7 mm in width and approximately 40 to 60 mm in length. In a small-scaled image forming apparatus, it may be difficult to secure a space for mounting the probe around the image carrying member.

In addition, controlling the charging voltage based on an indirect parameter such as the temperature of the installation environment has a limit in accuracy of adjusting the surface potential of the image carrying member to the target potential.

The present invention has been made in view of such conventional circumstances, and it is an object of the present invention to provide an image forming apparatus that can adjust the surface potential of the image carrying member to the target potential with high accuracy even when a space around the image carrying member is narrow.

Solution to the Problems

An image forming apparatus according to an aspect of the present invention includes an image carrying member, a charging device, a laser scanning device, a developing device, a seal member, an electrode film, a potential detecting device, and a charging controller. The charging device includes a charging member that faces an outer circumferential surface of the image carrying member, and charges the outer circumferential surface of the image carrying member via the charging member by applying a charging voltage to the charging member. The laser scanning device writes an electrostatic latent image on the outer circumferential surface of the image carrying member that has been charged, by scanning a light beam on the outer circumferential surface. The developing device develops the electrostatic latent image on the outer circumferential surface of the image carrying member, to a toner image. The seal member is supported by the developing device. The seal member is formed to project from an edge part of the developing device that faces the image carrying member, along a longitudinal direction of the image carrying member. The seal member is a non-conductive, flexible member filling a part of a gap between the developing device and the outer circumferential surface of the image carrying member. The electrode film is adhered to a surface of the seal member. The electrode film is a conductive film formed along the longitudinal direction of the image carrying member. The potential detecting device detects a potential of the electrode film. The charging controller controls the charging voltage applied to the charging member, based on a result of comparison between a predetermined reference potential and the potential detected by the potential detecting device.

Advantageous Effects of the Invention

According to the present invention, it is possible to provide an image forming apparatus that can adjust the surface potential of the image carrying member to the target potential with high accuracy even when a space around the image carrying member is narrow.

DESCRIPTION OF EMBODIMENTS

Figure 1:
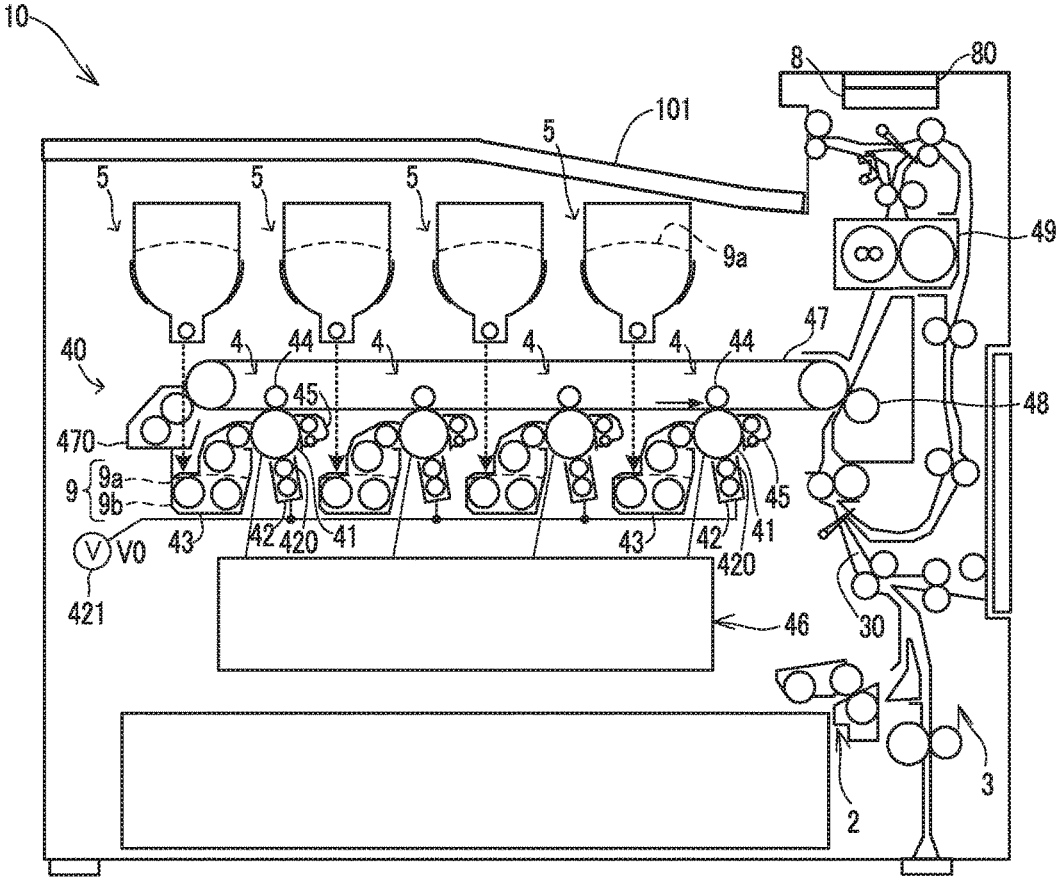
FIG. 1 is a configuration diagram of an image forming apparatus according to an embodiment.

The following describes an embodiment of the present invention with reference to the accompanying drawings. It should be noted that the following embodiment is an example of a specific embodiment of the present invention and should not limit the technical scope of the present invention.

[Configuration of Image Forming Apparatus 10]

An image forming apparatus 10 forms an image on a sheet by an electrophotographic system. The sheet is a sheet-like image formation medium such as a sheet of paper or an envelope.

The image forming apparatus 10 includes a sheet supply device 2, a sheet conveying device 3, an image forming portion 40, a toner replenishing unit 5, a controller 8, and an operation/display device 80. The image forming portion 40 includes an image creating unit 4, an LSU (Laser Scanning Unit) 46, and a fixing device 49.

The sheet supply device 2 feeds sheets one by one from a sheet storage part storing a plurality of sheets to a conveyance path 30. The sheet conveying device 3 conveys the sheet along the conveyance path 30, and discharges the sheet with an image formed thereon, from the conveyance path 30 to a discharge tray 101.

The image creating unit 4 executes a developing process and a transfer process by using powdery developer 9. The image forming apparatus 10 shown in FIG. 1 is a tandem-type image forming apparatus, and is a color printer. As a result, the image forming apparatus 10 includes a plurality of image creating units 4, an intermediate transfer belt 47, a secondary transfer device 48, and a secondary cleaning device 470, wherein the plurality of image creating units 4 respectively correspond to colors of cyan, magenta, yellow, and black.

Each of the image creating units 4 includes a photoconductor 41, a charging device 42, a developing device 43, a primary transfer device 44, and a primary cleaning device 45. The photoconductor 41 is a rotator on whose outer circumferential surface an electrostatic latent image is written, and is an example of the image carrying member.

In each of the image creating units 4, the drum-like photoconductor 41 rotates, and the charging device 42 uniformly charges the outer circumferential surface of the photoconductor 41. The charging device 42 includes a charging member 420 and a charging power supply circuit 421.

The charging member 420 is disposed to face the outer circumferential surface of the photoconductor 41. In the present embodiment, the charging member 420 is a charging roller configured to rotate while in contact with the outer circumferential surface of the photoconductor 41. The charging power supply circuit 421 applies a charging voltage V0 to the charging member 420.

For example, the charging power supply circuit 421 may include a DC power supply circuit and an AC power supply circuit. The DC power supply circuit outputs a DC voltage of a level set by the controller 8. The AC power supply circuit outputs an AC voltage that vibrates with an amplitude set by the controller 8. In this case, the charging power supply circuit 421 applies a charging voltage V0 in which an AC voltage is superimposed on a DC voltage, to the charging member 420.

By applying the charging voltage V0 to the charging member 420, the charging device 42 charges the outer circumferential surface of the photoconductor 41 via the charging member 420.

It is noted that although the charging power supply circuit 421 is shown in a simplified manner in FIG. 1, the charging power supply circuit 421 is configured to apply charging voltages V0 of different levels to the plurality of charging members 420 of the plurality of image creating units 4 individually.

The LSU 46 writes the electrostatic latent image on the charged outer circumferential surface of the charged photoconductor 41, by scanning a light beam on the outer circumferential surface of the photoconductor 41. For example, the LSU 46 includes a laser light source, a laser scanner, and an fθ lens. The laser light source emits the light beam. The laser scanner is a polygon mirror or the like that causes the light beam to scan. The fθ lens adjusts the scanning speed of the light beam on the outer circumferential surface of the photoconductor 41. The LSU 46 is an example of the laser scanning device.

The developing device 43 develops the electrostatic latent image on the photoconductor 41 as a toner image by using the developer 9 that includes toner 9*a*. In the present embodiment, the developer 9 is a two-component developer including the toner 9*a* and carrier 9*b*. The carrier 9*b* has magnetism and is granular. As many toner replenishing units 5 as the number of colors of the toner 9*a* are provided. The toner replenishing units 5 replenish the toner 9*a* to the developing devices 43.

It is noted that the developer 9 may be magnetic toner. In that case, the developing device 43 develops the electrostatic latent image on the photoconductor 41 as a toner image, by a one-component developing system.

The primary transfer device 44 transfers the toner image from the surface of the photoconductor 41 to the intermediate transfer belt 47. The primary cleaning device 45 removes residual toner 9*a* from the surface of the photoconductor 41.

The secondary transfer device 48, in the conveyance path 30, transfers the toner image formed on the intermediate transfer belt 47, to the sheet. The secondary cleaning device 470 removes residual toner 9*a* from the intermediate transfer belt 47.

The fixing device 49 fixes the toner image transferred to the sheet, to the sheet by heating the toner image.

[Configuration of Developing Device 43]

Figure 2:
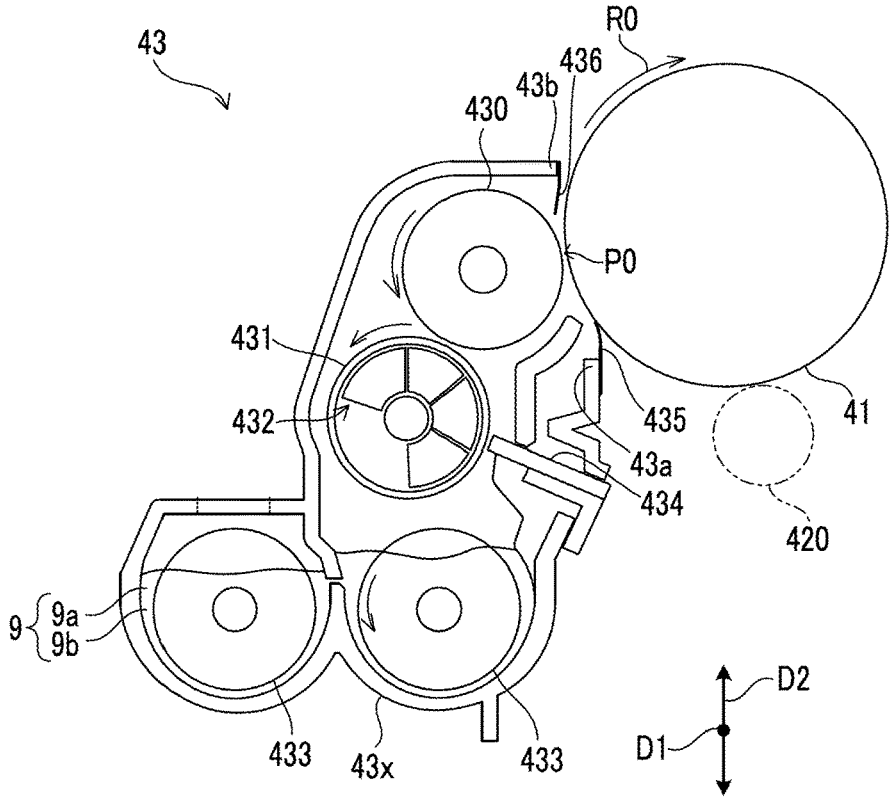
FIG. 2 is a configuration diagram of a developing device of the image forming apparatus according to the embodiment.

As shown in FIG. 2, the developing device 43 includes a developing tank 43*x*, a developing roller 430, and stirring screws 433, wherein the developing tank 43*x* stores the developer 9, and the developing roller 430 and the stirring screws 433 rotate in the developing tank 43*x*.

The stirring screws 433 cyclically convey, while stirring, the developer 9 in the developing tank 43*x*. The toner 9*a* is charged by being stirred. The developing roller 430 supplies the toner 9*a* to the outer circumferential surface of the photoconductor 41 by rotating while carrying the toner 9*a*.

As shown in FIG. 2, the developing device 43 performs developing by a so-called interactive touchdown system. As a result, the developing device 43 includes the magnetic roller 431 and the developing roller 430, individually.

The cylindrical magnetic roller 431 includes a magnet 432 in the interior thereof, and rotates while carrying the toner 9*a* and the carrier 9*b* on its outer circumferential surface. The magnetic roller 431 carries the developer 9 by a magnetic force of the magnet 432 provided in the interior thereof. The developing roller 430 rotates while carring the toner 9*a* supplied from the magnetic roller 431.

In addition, the developing device 43 includes a blade 434 that restricts, in thickness, the layer of the developer 9 carried on the outer circumferential surface of the magnetic roller 431.

It is noted that the developing device 43 may perform the developing by a two-component developing system. In that case, the magnetic roller 431 functions as the developing roller 430.

Figure 3:
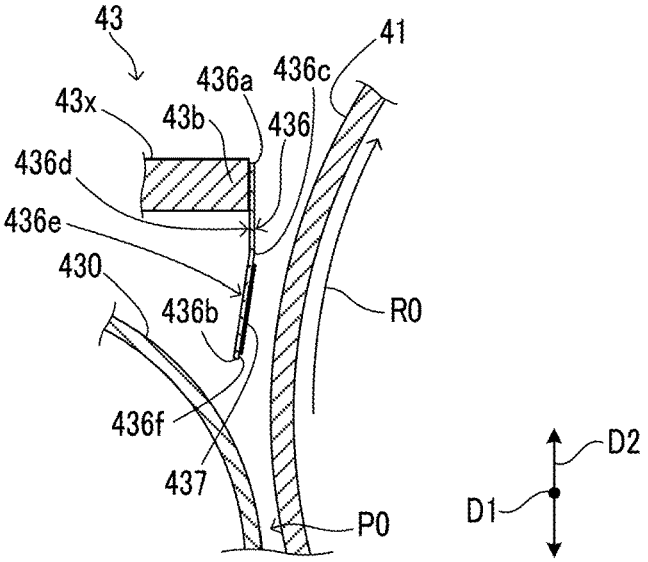
FIG. 3 is a cross-sectional diagram of a peripheral portion of a downstream seal member of the image forming apparatus according to the embodiment.
Figure 4:
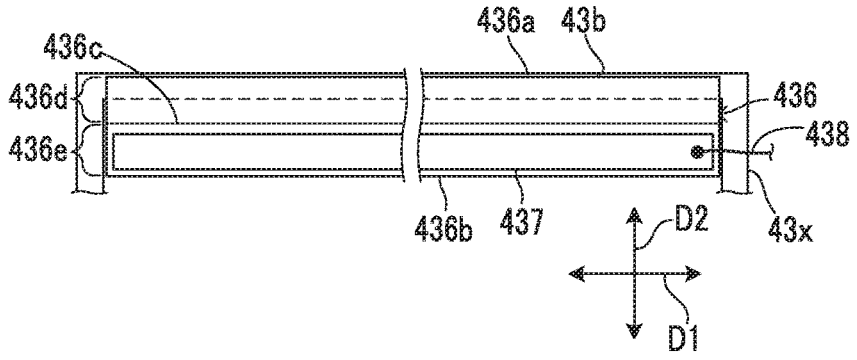
FIG. 4 is a front diagram of a peripheral portion of the downstream seal member of the image forming apparatus according to the embodiment.

In the following description, the rotation direction of the photoconductor 41 is referred to as a drum rotation direction R0. In addition, the longitudinal direction of the photoconductor 41 is referred to as a drum longitudinal direction D1. The drum longitudinal direction D1 extends along the rotation axis of the photoconductor 41, and is a main scanning direction. The main scanning direction is a direction in which the LSU 46 scans the laser light. It is noted that as shown in FIG. 2 to FIG. 4, the drum longitudinal direction D1 is perpendicular to a vertical direction D2.

In addition, a position on the outer circumference of the photoconductor 41 that faces the developing roller 430 is referred to as a developing position P0. The electrostatic latent image is developed to the toner image at the developing position P0.

The developing device 43 includes an upstream seal member 435 and a downstream seal member 436. The upstream seal member 435 and the downstream seal member 436 are supported by an edge part of an opening that allows a part of the developing roller 430 in the developing tank 43*x* to be exposed.

The upstream seal member 435 is formed to project from an upstream edge part 43*a* of the developing tank 43*x*, and is formed along the drum longitudinal direction D1. The upstream edge part 43*a* is an edge part of the developing device 43 that faces the photoconductor 41 at a position upstream of the developing position P0 of the photoconductor 41 in the drum rotation direction R0.

A tip part of the upstream seal member 435 is in contact with the outer circumferential surface of the photoconductor 41. The upstream seal member 435 is a non-conductive, flexible member configured to fill a gap between the developing device 43 and the outer circumferential surface of the photoconductor 41. For example, the upstream seal member 435 may be a rubber member such as an urethane rubber sheet.

The downstream seal member 436 is formed to project from a downstream edge part 43*b* of the developing tank 43*x*, and is formed along the drum longitudinal direction D1. The downstream edge part 43*b* is an edge part of the developing device 43 that faces the photoconductor 41 at a position downstream of the developing position P0 of the photoconductor 41 in the drum rotation direction R0.

There is a slight gap between a tip 436*b* of the downstream seal member 436 and the outer circumferential surface of the photoconductor 41. The downstream seal member 436 is a non-conductive, flexible member configured to fill a part of the gap between the developing device 43 and the outer circumferential surface of the photoconductor 41. For example, the downstream seal member 436 may be a film member formed from a synthetic resin such as PET (polyethylene terephthalate). In that case, the thickness of the downstream seal member 436 is approximately 0.1 to 0.2 mm.

The upstream seal member 435 and the downstream seal member 436 prevent the toner 9*a* flying around the developing roller 430 from being scattered from the gap between the developing device 43 and the photoconductor 41. In addition, the flexible upstream seal member 435 does not damage the outer circumferential surface of the photoconductor 41 even when it is in contact with the outer circumferential surface of the photoconductor 41. Similarly, the flexible downstream seal member 436 does not damage the outer circumferential surface of the photoconductor 41 even when it comes into contact with the outer circumferential surface of the photoconductor 41 when the developing device 43 is replaced.

The controller 8 controls electric equipment in the image forming apparatus 10. For example, the controller 8 may include a processor such as an MPU (Micro Processor Unit) or a DSP (Digital Signal Processor), or an integrated circuit such as an ASIC (Application Specific Integrated Circuit).

The operation/display device 80 is a user interface device that includes an operation device and a display device, wherein the operation device receives user operations, and the display device displays information. For example, the operation device may include a touch panel and operation buttons, and the display device may include a display panel such as a liquid crystal panel.

In the image forming apparatus 10, charging the outer circumferential surface of the photoconductor 41 to a predetermined target potential is important to obtain a toner image of an excellent image quality. Accordingly, as described below, the controller 8 controls the charging voltage V0 applied to the charging member 420 so that the outer circumferential surface of the photoconductor 41 is charged to the target potential. In conventional apparatuses, a surface potential sensor for detecting the surface potential of the photoconductor 41 in a contactless manner is used to control the charging voltage V0.

Meanwhile, a typical surface potential sensor has a probe which is approximately 5 to 7 mm in width and approximately 40 to 60 mm in length. In a small-scaled image forming apparatus 10, it may be difficult to secure a space for mounting the probe around the photoconductor 41.

In addition, controlling the charging voltage V0 based on an indirect parameter such as the temperature of the installation environment of the image forming apparatus 10 has a limit in accuracy of adjusting the surface potential of the photoconductor 41 to the target potential.

The image forming apparatus 10 includes an electrode film 437 that can be mounted even when a space around the photoconductor 41 is narrow (see FIG. 3 and FIG. 4). As described below, the electrode film 437 is used to detect a change in the surface potential of the photoconductor 41. The image forming apparatus 10 controls the charging voltage V0 based on the potential of the electrode film 437. With this configuration, it is possible to adjust the surface potential of the photoconductor 41 to the target potential with high accuracy even when a space around the photoconductor 41 is narrow. The following describes the electrode film 437 and control of the electrode film 437.

[Electrode Film 437 and Control of Electrode Film 437]

As shown in FIG. 3 and FIG. 4, the electrode film 437 is a conductive film adhered to a surface of the downstream seal member 436. The electrode film 437 is formed to extend along the drum longitudinal direction D1 (see FIG. 4). The electrode film 437 is adhered to a surface of the downstream seal member 436 that faces the photoconductor 41, by adhesive or the like.

For example, the electrode film 437 may be made of a metal whose main component is copper, aluminum, or stainless steel. For example, the electrode film 437 may be approximately 0.1 to 0.3 mm in thickness. As shown in FIG. 4, a lead wire 438 is electrically connected with the electrode film 437.

As shown in FIG. 3 and FIG. 4, a part of the downstream seal member 436 close to a base end 436*a* thereof is fixed to the downstream edge part 43*b* of the developing tank 43*x*. In addition, the downstream seal member 436 includes a bent part 436*c* that forms a ridge line along the drum longitudinal direction D1.

In the downstream seal member 436, a first part 436*d* located closer to the base end 436*a* than the bent part 436*c* is formed to project from the downstream edge part 43*b* in a direction approaching the outer circumferential surface of the photoconductor 41.

In the downstream seal member 436, a second part 436*e* located closer to the tip 436*b* than the bent part 436*c* is formed along the outer circumferential surface of the photoconductor 41. One main surface of the second part 436*e* is a facing surface 436*f* that faces the outer circumferential surface of the photoconductor 41. The electrode film 437 is adhered to the facing surface 436*f* of the second part 436*e* of the downstream seal member 436.

When the outer circumferential surface of the photoconductor 41 is charged, a potential that is proportional to the surface potential of the photoconductor 41 is generated on the electrode film 437 disposed in proximity to the outer circumferential surface of the photoconductor 41. As a result, a change in the potential of the electrode film 437 represents a change in the surface potential of the photoconductor 41.

Figure 5:
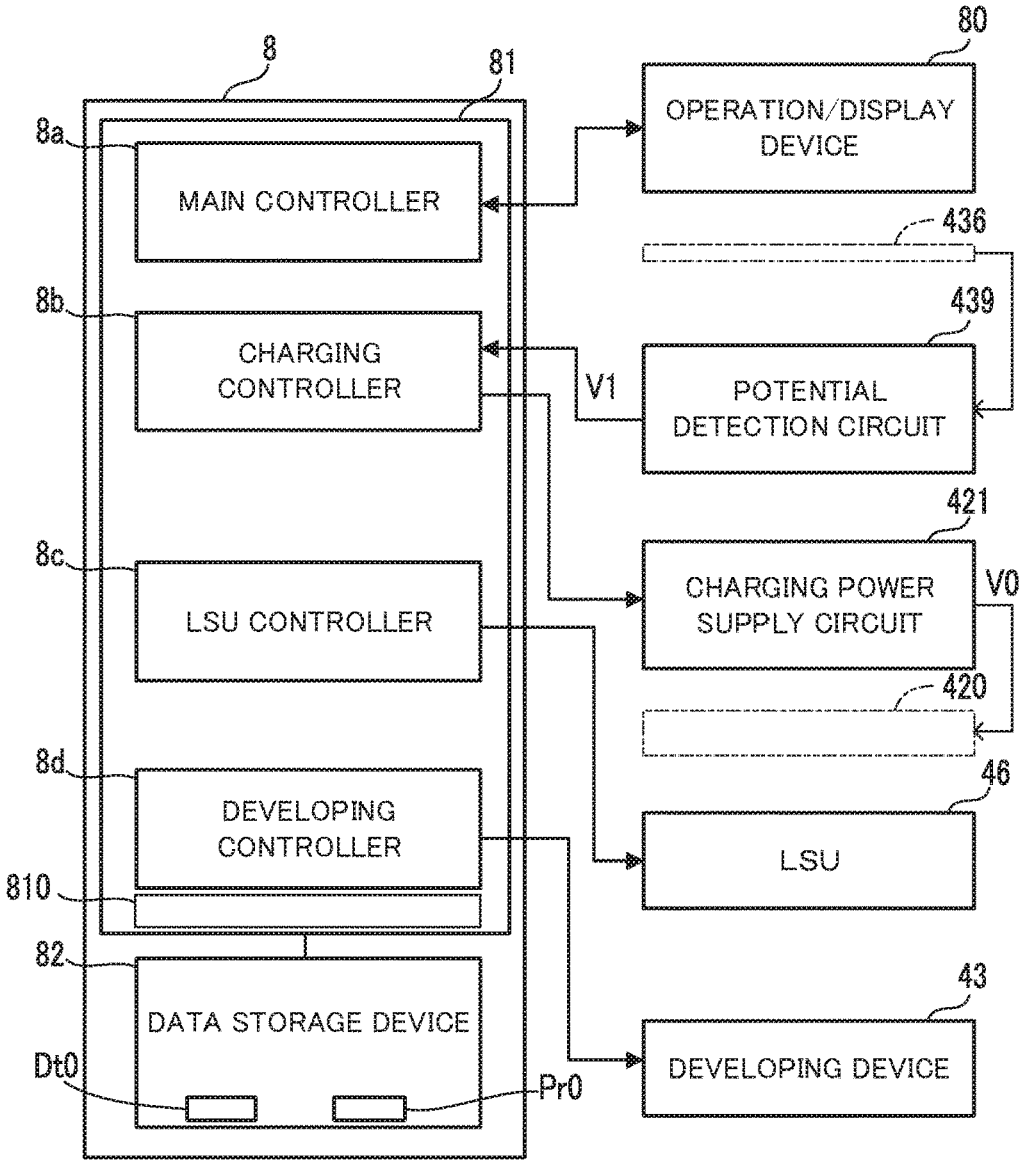
FIG. 5 is a block diagram of a control-related portion of the image forming apparatus according to the embodiment.

As shown in FIG. 5, the image forming apparatus 10 further includes a potential detection circuit 439 configured to detect the potential of the electrode film 437. The potential detection circuit 439 is electrically connected with the electrode film 437 via the lead wire 438. The potential detection circuit 439 is a general circuit that detects a minute DC potential that is generated on the electrode film 437. It is noted that the potential detection circuit 439 is an example of the potential detecting device.

For example, the potential detection circuit 439 includes a DC voltage detection circuit, an amplification circuit, and an insulation circuit. The DC voltage detection circuit detects a DC voltage of the electrode film 437 by using the ground potential as a reference. The amplification circuit generates a primary voltage by amplifying an output voltage of the DC voltage detection circuit. The insulation circuit electrically insulates an output terminal of the potential detection circuit 439 and the amplification circuit, and outputs a signal of a secondary voltage proportional to the primary voltage, as a signal of a detected potential V1.

In addition, as shown in FIG. 5, the controller 8 includes an MPU 81 and a data storage device 82. The MPU 81 includes a RAM (Random Access Memory) 810 that temporarily stores a control program Pr0 that is stored in advance in the data storage device 82. The MPU 81 functions as a main controller 8*a*, a charging controller 8*b*, an LSU controller 8*c*, and a developing controller 8*d* by executing the control program Pr0 expanded in the RAM 810.

The data storage device 82 is a computer-readable, non-volatile storage device. For example, the data storage device 82 may be a ROM (Read Only Memory) or a flash memory.

The data storage device 82 stores in advance the control program Pr0 and reference potential data Dt0, wherein the reference potential data Dt0 represents a reference potential that is a potential of the electrode film 437 in a state where the charging voltage V0 has been adjusted to an initial value. The reference potential data Dt0 is described below.

When a predetermined adjustment mode event occurs, the main controller 8*a* changes the operation mode of the image forming apparatus 10 from a normal mode to a predetermined adjustment mode. For example, the adjustment mode event is that a predetermined adjustment start operation was performed on the operation device of the operation/display device 80, or that the number of print pages has reached a predetermined number of pages.

When the operation mode is set to the adjustment mode, the charging controller 8*b* operates the charging power supply circuit 421. This allows the charging device 42 to charge the outer circumferential surface of the photoconductor 41. When the operation mode is first set to the adjustment mode, the charging voltage V0 has been set to the initial value as adjusted in the manufacturing process of the image forming apparatus 10.

In the adjustment mode, the LSU controller 8*c* causes the LSU 46 to execute a predetermined test latent image writing process. In the test latent image writing process, the LSU 46 writes the electrostatic latent image that extends like a line or a belt along the drum longitudinal direction D1, on the outer circumferential surface of the photoconductor 41 a plurality of times continuously at equal intervals.

After an execution of the test latent image writing process, high-potential portions and low-potential portions are formed alternately in the circumferential direction on the outer circumferential surface of the photoconductor 41, wherein the high-potential portions are portions charged by the charging device 42 to the target potential or a potential close to the target potential, and the low-potential portions extend along the drum longitudinal direction D1 like lines or belts.

Figure 6:
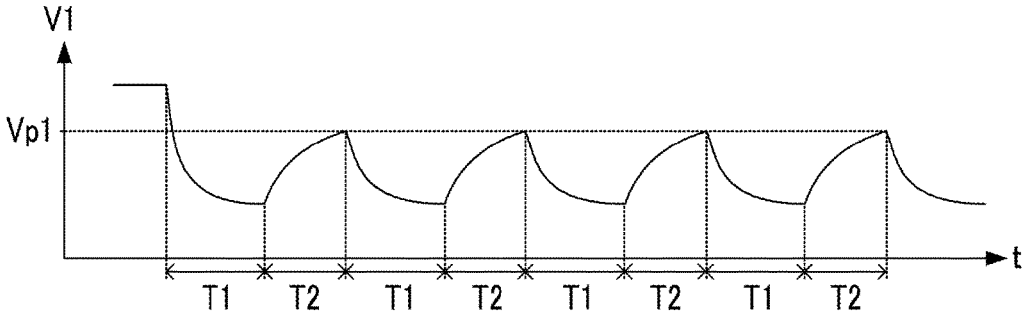
FIG. 6 is a trend graph showing an example of a change in potential of an electrode film when the image forming apparatus is in an adjustment mode.

Accordingly, as shown in FIG. 6, the detected potential V1 detected by the potential detection circuit 439 changes at a fixed cycle. In FIG. 6, first periods T1 represent time periods during which the low-potential portions pass the front of the electrode film 437, and second periods T2 represent time periods during which the high-potential portions pass the front of the electrode film 437.

In the adjustment mode, the charging controller 8*b* controls the charging voltage V0 based on a result of a comparison between a peak value Vp1 of the detected potential V1 that changes in time series, and the reference potential represented by the reference potential data Dt0 stored in advance in the data storage device 82.

For example, the potential detection circuit 439 may include a peak latch circuit that holds the peak value Vp1 of the detected potential V1 that changes in time series. In that case, the peak latch circuit outputs a detection signal that represents the peak value Vp1 at intervals of a time that is obtained by adding the first period T1 and the second period T2 shown in FIG. 6.

It is noted that the width of the first period T1 and the second period T2 is a known time that can be derived from the circumferential speed of the photoconductor 41 and the width and the writing interval of the line-like or belt-like electrostatic latent image. The line-like or belt-like electrostatic latent image is formed during the test latent image writing process.

In addition, the charging controller 8*b* may detect the peak value Vp1 of the detected potential V1 by sampling the level of the detected potential V1 at a high speed.

Since the electric characteristics of the electrode film 437 are constant, the time constant of the change of the detected potential V1 is constant. Accordingly, the peak value Vp1 of the detected potential V1 is proportional to the surface potential of the photoconductor 41. The test latent image writing process is executed to prevent the detected potential V1 from being saturated.

The reference potential data Dt0 represents the reference potential that was adjusted during the manufacturing process of the image forming apparatus 10. During the manufacturing process of the image forming apparatus 10, the test latent image writing process is executed in a state where the surface potential of the photoconductor 41 is within a predetermined acceptable range with respect to the target potential. The peak value Vp1 of the detected potential V1 detected during that time is the reference potential.

Accordingly, in the adjustment mode, a state where the peak value Vp1 of the detected potential V1 is within a predetermined tolerable range with respect to the reference potential, is a state where the surface potential of the photoconductor 41 is approximately within the acceptable range with respect to the target potential.

In the adjustment mode, when the peak value Vp1 of the detected potential V1 is higher than the tolerable range with respect to the reference potential, the charging controller 8*b* corrects the charging voltage V0 to a level that is lower than the current value. Similarly, when the peak value Vp1 of the detected potential V1 is lower than the tolerable range with respect to the reference potential, the charging controller 8*b* corrects the charging voltage V0 to a level that is higher than the current value.

A correction width per correction of the charging voltage V0 is obtained by, for example, multiplying a predetermined proportional coefficient by a potential difference between the reference potential and the peak value Vp1 of the detected potential V1. In addition, the charging controller 8*b* may correct the level of a DC voltage in the charging voltage V0 on which the DC voltage and an AC voltage are superimposed.

The charging controller 8*b* repeats correction of the charging voltage V0 until the peak value Vp1 of the detected potential V1 becomes within the tolerable range with respect to the reference potential. When the peak value Vp1 of the detected potential V1 has become within the tolerable range with respect to the reference potential, the charging controller 8*b* ends the adjustment mode.

It is noted that in the present embodiment, the electrode film 437 and the potential detection circuit 439 are provided in each of a plurality of developing devices 43 that respectively correspond to the different colors of the toner 9*a*. In addition, the reference potential data Dt0 stored in advance in the data storage device 82 is individual for each of the plurality of photoconductors 41. Furthermore, the charging controller 8*b* individually corrects a plurality of charging voltages V0 that respectively correspond to the different colors of the toner 9*a*.

In the image forming apparatus 10, the downstream seal member 436 serves as both a member for preventing the flying toner from being scattered, and a member supporting the electrode film 437. In addition, the thin electrode film 437 can be mounted even when a space around the photoconductor 41 is narrow.

Accordingly, with the adoption of the image forming apparatus 10, it is possible to adjust the surface potential of the photoconductor 41 to the target potential with high accuracy even when a space around the photoconductor 41 is narrow.

In addition, the electrode film 437 is adhered to the facing surface 436*f* of the downstream seal member 436 that faces the outer circumferential surface of the photoconductor 41 (see FIG. 3). This makes it possible to detect a change in the surface potential of the photoconductor 41 with high sensitivity.

Furthermore, the downstream edge part 43*b* of the developing tank 43*x* faces the photoconductor 41 at a position downstream of the developing position P0 in the drum rotation direction R0. The downstream seal member 436 is formed to project from the downstream edge part 43*b*. The electrode film 437 is adhered to the downstream seal member 436. In this case, the electrode film 437 is disposed in proximity to the outer circumferential surface of the photoconductor 41, in a contactless manner. This makes it possible to detect a change in the surface potential of the photoconductor 41 with high sensitivity.

Application Examples

In the above-described image forming apparatus 10, the electrode film 437 may be adhered to a part of the upstream seal member 435 that does not come into contact with the photoconductor 41.

In addition, in the adjustment mode, the charging controller 8*b* may control the charging voltage V0 based on a result of a comparison between an average value of the detected potential V1 that changes in time series, and the reference potential represented by the reference potential data Dt0.

For example, the charging controller 8*b* may add the first period T1 and the second period T2 shown in FIG. 6, and compare the reference potential with an average value of the detected potential V1 at intervals of a time that is obtained by adding the first period T1 and the second period T2. In this case, the reference potential adjusted in the manufacturing process of the image forming apparatus 10 is an average value of the detected potential V1 detected in a state where the surface potential of the photoconductor 41 is within the acceptable range with respect to the target potential.

It is noted that the image forming apparatus of the present invention may be configured by freely combining, within the scope of claims, the above-described embodiments and application examples, or by modifying the embodiments and application examples or omitting a part thereof.

The invention claimed is:

1. An image forming apparatus comprising:

an image carrying member;

a charging device including a charging member that faces an outer circumferential surface of the image carrying member, and configured to charge the outer circumferential surface of the image carrying member via the charging member by applying a charging voltage to the charging member;

a laser scanning device configured to write an electrostatic latent image on the outer circumferential surface of the image carrying member that has been charged, by scanning a light beam on the outer circumferential surface;

a developing device configured to develop the electrostatic latent image on the outer circumferential surface of the image carrying member, to a toner image;

a non-conductive, flexible seal member supported by the developing device, formed to project from an edge part of the developing device that faces the image carrying member, along a longitudinal direction of the image carrying member, and configured to fill a part of a gap between the developing device and the outer circumferential surface of the image carrying member;

an electrode film being a conductive film, adhered to a surface of the seal member, and formed along the longitudinal direction of the image carrying member;

a potential detecting device configured to detect a potential of the electrode film; and a charging controller configured to control the charging voltage applied to the charging member, based on a result of comparison between a predetermined reference potential and the potential detected by the potential detecting device.

2. The image forming apparatus according to claim 1, wherein the seal member includes a bent part that forms a ridge line along the longitudinal direction of the image carrying member, in the seal member, a surface of a part located closer to a tip than the bent part includes a facing surface that faces the outer circumferential surface of the image carrying member, and the electrode film is adhered to the facing surface of the seal member.

3. The image forming apparatus according to claim 1, wherein the edge part faces the image carrying member at a position downstream of a developing position of the image carrying member in a rotation direction of the image carrying member.

4. The image forming apparatus according to claim 1, wherein when an operation mode is in a predetermined adjustment mode, the charging device charges the outer circumferential surface of the image carrying member, the laser scanning device writes the electrostatic latent image that extends like a line or a belt along the longitudinal direction of the image carrying member, on the outer circumferential surface of the image carrying member a plurality of times continuously at equal intervals, and the charging controller controls the charging voltage based on a result of a comparison between the reference potential and a peak value or an average value of the detected potential that changes in time series.

* * * * *